US005587693A

United States Patent [19]

Fear

[11] Patent Number: 5,587,693

[45] Date of Patent: Dec. 24, 1996

[54] POLARIZED ELECTROMAGNETIC RELAY

[75] Inventor: Christopher Fear, Brighton, Mich.

[73] Assignee: Siemens Electromechanical Components, Inc., Princeton, Ind.

[21] Appl. No.: 512,001

[22] Filed: Aug. 7, 1995

[51] Int. Cl.[6] ..... H01H 51/22

[52] U.S. Cl. ..... 335/78; 335/83

[58] Field of Search ..... 335/78–86, 124, 335/128

[56] References Cited

U.S. PATENT DOCUMENTS 4,993,787 2/1991 Tanaka et al. ..... 335/128

5,153,543 10/1992 Hitachi et al. ..... 335/78

*Primary Examiner*—Lincoln Donovan

*Attorney, Agent, or Firm*—Donald B. Paschburg

[57] ABSTRACT

A polarized electromagnetic relay includes a base, an electromagnet with a coil and a pair of pole pieces extending perpendicularly from the end of said coil, a balanced armature and spring system which when actuated pivots between two fixed contact points and a permanent magnet inducing the same magnetic poles in both of said pole pieces and providing an opposite pole in closely adjacent relationship to the central portion of the armature. A movable contact spring is fixedly connected to the armature, said spring forming contact arms at either armature end portion and a pair of torsion pivot arms extending transversely in opposite directions along the pivot axis of said armature, the distal ends of either pivot arm being fixedly connected to a support extending on either side of the armature from a coil bobbin. Further, a flexible movable braid connects the movable contacts on said movable spring to each other and to a movable contact terminal. Two identical coils wound in a common direction are provided as the means for actuation. Armature transfer will occur by either applying a voltage pulse across the appropriate coil, or by toggling the voltage pulse polarity across the two coils connected in series.

20 Claims, 7 Drawing Sheets

POLARIZED ELECTROMAGNETIC RELAY

TECHNICAL FIELD OF THE INVENTION

The present invention relates to a polarized electromagnetic relay, featuring a balanced armature and spring system which, when actuated, pivots between two fixed contact points.

BACKGROUND OF THE INVENTION

Polarized electromagnetic relays with a swingable armature pivoted at its center are known, for example, as disclosed in U.S. Pat. No 4,695,813. This known design comprises a center pivoted armature resting atop a permanent magnet which spans two interconnected pole pieces. In this known relay, the balanced armature is connected to a pair of movable contact springs each being formed with a transversely extending torsion pivot arm which is fixedly connected to a portion of a casing. In particular, the pivot arms serve as electrical connections for the respective contact springs and are connected to respective terminals mounted on the casing.

This design approach has been implemented in relays best suited for applications containing relatively low load currents, such as telecommunication equipment. At such levels, the connection between the movable contacts and the movable terminal can be made via a current carrying spring member. However, due to the pivoting motion of the armature, the spring must be designed to be sufficiently pliable to prevent the generation of excessive torsion forces, as well as to prevent fatigue related failures. As a result, the connecting spring member must be designed with a relatively small cross section area, thus limiting its current carrying capacity. That means, the torsion pivot arms of the known relay are not capable of conducting power currents as occur in automotive or general purpose applications.

SUMMARY OF THE INVENTION

The principal objective of this invention is to produce a polarized electromagnetic latching relay capable of carrying steady state currents of higher levels, for example in excess of 30 amperes.

It is a further object of the present invention to provide a polarized electromagnetic relay having a balanced armature, wherein the armature spring assembly is designed in such a manner to prevent excessive armature motion during severe shock conditions, as well as during the magnetization process.

It is a still further object of the present invention to provide a polarized electromagnetic relay in which the contact spring and pivot arm functions are separated from the load current conducting function for the movable contacts, so as to provide excellent shock resistant characteristics of the balanced armature design and optimal spring characteristics for providing a desired contact force, while the torsion forces generated by a separate conductive element are minimized.

It is another object of the present invention to provide a polarized relay with a balanced armature and spring system wherein the balancing armature pivot arms are supported on the coil assembly itself, preferably on a bobbin flange or another part, like a magnet, fixedly connected to the bobbin, thus providing simple assembling steps and exact adjustment of the armature with respect to the coil, permanent magnet and pole pieces.

It is still another object of the present invention to provide a polarized electromagnetic relay which can be built for either a single or dual input, where in the single input version a single coil supply is used to operate the relay by reversing coil polarity, while in the dual input two separate coil voltage sources are used to operate the relay. These and other objects are achieved by the present invention which provides a polarized electromagnetic relay comprising:

an insulating base defining a bottom plane;

an electromagnet block on the base having a core, means for exciting a coil including a bobbin and at least one winding about the core, and a pair of pole pieces extending perpendicularly from the ends of said core;

an elongate armature pivotally supported at its central portion to be movable about a center pivot axis for angular movement between two contact operating positions, either end portion of the armature on either side of the pivot axis defining an air gap with one of said pole pieces;

a permanent magnet coupled magnetically between said core and said armature so as to induce the same magnetic poles in both said pole pieces and to provide an opposite pole in closely adjacent relationship to said central portion of the armature;

at least one movable contact spring fixedly connected to the armature at a portion intermediate the ends thereof and being formed with contact arms in the vicinity of either armature end portion, said contact arms carrying movable contacts to be moved according to the armature movement in and out of contact with corresponding fixed contacts mounted on said base;

a pair of torsion pivot arms extending transversely in opposite directions from said at least one contact spring along the pivot axis of said armature, the distal end of either pivot arm being fixedly connected to a support extending on either side of the armature and being part of or fixedly connected to said electromagnetic block; and a conductor connecting said contact arms with a movable contact terminal mounted on said base.

According to the invention, the relay may be constructed having more than one movable spring to form e.g. a double-pole relay, wherein a pair of contact springs would be mounted on the armature having insulation with respect to each other and to the armature. However, in a preferred embodiment only one single contact spring having a pair of contact arms is fixedly connected to the armature without a need of insulation therebetween. In this case, the whole structure of the relay is quite simple with only two fixed contact terminals and one movable contact terminal, which can be mounted in the base as simply bar-shaped terminal members extending perpendicular to the base plane.

Since the contacts are connected directly via a conductor with each other and to the movable contact terminal, the movable spring which is made preferably in one piece with the pivot arms can be designed merely with respect to excellent spring properties so as to provide the desired contact forces and to have excellent torsion properties in the pivot arm areas. The movable spring is made preferably from a material having excellent resilience, such as stainless steel, but may have poor conductivity.

Advantageously, the invention provides that the pivot arms are fixedly mounted on the coil unit itself, and there is no need of supporting the armature pivot arms on the base or a separate casing. Thus, the armature can be mounted and adjusted exactly with respect to the core and magnet system before the motor unit is assembled with the base of the relay. Preferably, the bobbin has a center flange providing a pair of posts projecting on either side of the armature and forming supports for fastening the distal ends of said pivot arms.

Preferably, the permanent magnet consists of a bar-shaped or plate-shaped three-pole magnetized permanent magnet disposed between the free ends of the pole pieces, which magnet is magnetized to have the same poles at its lengthwise ends adjacent to the pole pieces and to have the opposite pole intermediate its ends adjacent to a central portion of the armature which is balanced upon this pole.

Alternatively, a plate-shaped or bar-shaped, two-pole permanent magnet may be provided, which is arranged in said center flange of the bobbin perpendicular to the axis of said core and coils, that magnet being coupled with one pole to said core and presenting the opposite pole to the armature which is balanced thereon.

BRIEF DESCRIPTION OF THE DRAWINGS

For a better understanding of the invention, reference is made to the following description of an exemplary embodiment thereof, and to the accompanying drawings, wherein.

DETAILED DESCRIPTION

Figure 1:
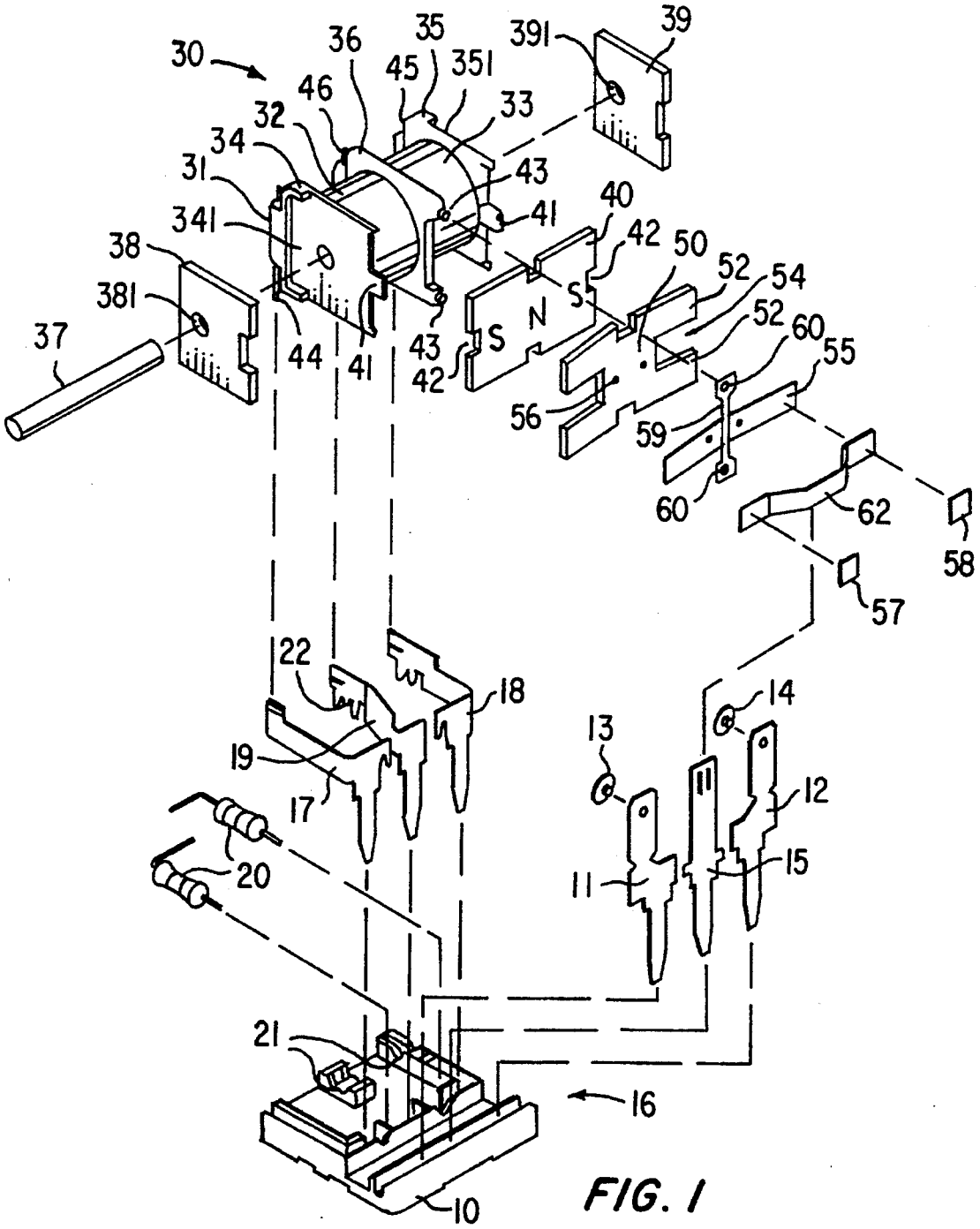
FIG. 1 is an exploded perspective view of a polarized relay constructed in accordance with the present invention.
Figure 2:
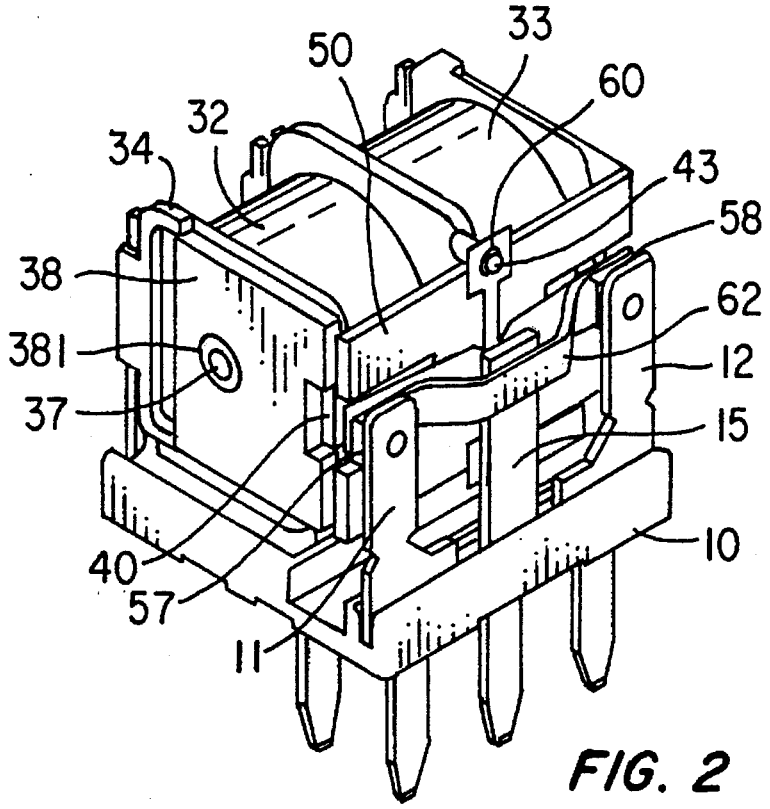
FIG. 2 is a perspective view of the assembled relay of FIG. 1.

Referring now to FIGS. 1 and 2, there is shown a polarized electromagnetic relay of the present invention. The relay is of bistable operation and of single-pole double-throw contact arrangement. The relay comprises a base 10 of insulating material which defines a main or bottom plane for the relay. A pair of stationary or fixed contact terminals 11 and 12 are fastened in the base 10; these fixed terminals 11 and 12 are disposed perpendicular to the bottom plane and are provided with fixed contacts 13 and 14. A movable contact terminal 15 is disposed parallel to the fixed contact terminals. All the terminals are inserted into slots 16 (not visible) in the base 10 and are fixed by caulking or by any other suitable sealant or method. Further, coil terminals 17 and 18 and a common coil terminal 19 are fastened in the base 10 in a similar manner. A pair of suppression resistors 20 or other components may be arranged on the base 10 and connected to the coil terminals 17, 18 and 19 by clamping their wires between clamping nuts 21 in the base and fork-like clamping claws 22 of the respective coil terminals. In a single input version (see FIG. 11B), the common coil terminal 19 as well as one of the suppression resistors 20 may be omitted.

An electromagnet block 30 arranged on the base 10 comprises a bobbin 31 with a pair of coils 32 and 33 wound thereon between end flanges 34 and 35 and a center flange 36. An iron core 37 of cylindrical shape is inserted axially into the bobbin and coils and is coupled at its ends to a pair of plate-like pole pieces 38 and 39 which are arranged in recesses 341 and 351, respectively, of the end flanges 34 and 35 and are provided with through holes 381 and 391, respectively, corresponding in diameter to the core 37.

A plate-like elongate permanent magnet 40 is disposed along one lateral side of the bobbin in a plane perpendicular to the base plane and bridging the end flanges 34 and 35 as well as the pole pieces 38 and 39. Retention features, for example deformable plastic tabs 41, are located on the end flanges 34 and 35 and mate with corresponding features, for example recesses 42, in the magnet 40 to prevent the magnet from backing out. The permanent magnet 40 is magnetized in a three-pole manner so as to have the same magnetic poles (south poles S) at both ends and the opposite pole (north pole N) in its center. An elongate, plate-like armature 50 which is slightly bent into a V-shape, is balanced on the center pole N of the permanent magnet 40 so as to form air gaps between its end portions and either one of the pole pieces 38 and 39. Either end of the armature is divided into a pair of legs 51 and 52, respectively, by means of recesses 53 and 54, respectively.

A strip-like movable contact spring 55 which is made from a resilient material like stainless steel, is fastened to the central part of the armature 50 by means of rivets 56 or the like. A pair of movable contacts 57 and 58 are fixed to the ends of the movable spring 55 by welding or any other suitable method. Since the movable spring 55 is made from a metal having poor conductivity, a flexible composite copper braid 62 is welded directly between the movable contacts 57 and 58 and the movable spring 55 to carry the load current between these movable contacts and the movable contact terminal 15.

Figure 3A:
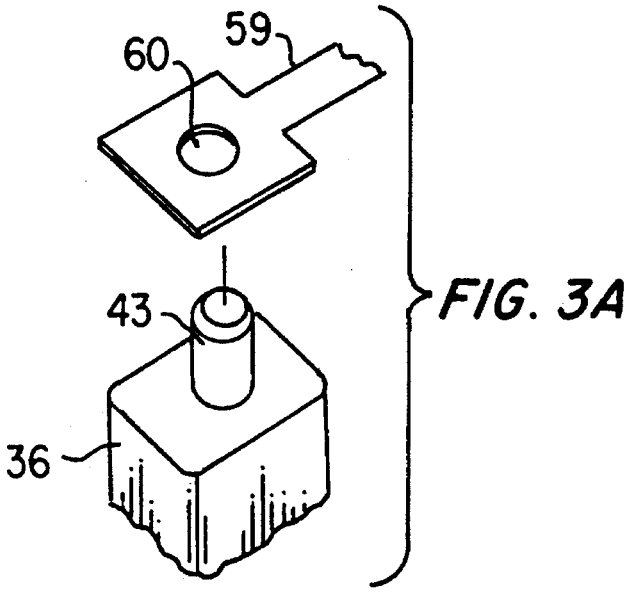
FIG. 3A is a fragmentary perspective view of a bobbin post and a pivot arm before fastening.
Figure 3B:
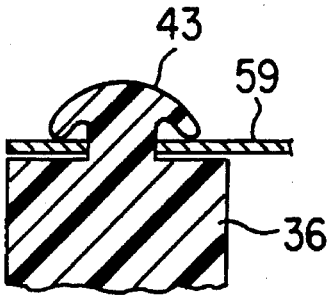
FIG. 3B is a fragmentary cross section of the bobbin post and pivot arm as in FIG. 3A, after fastening by heat staking.
Figure 4A:
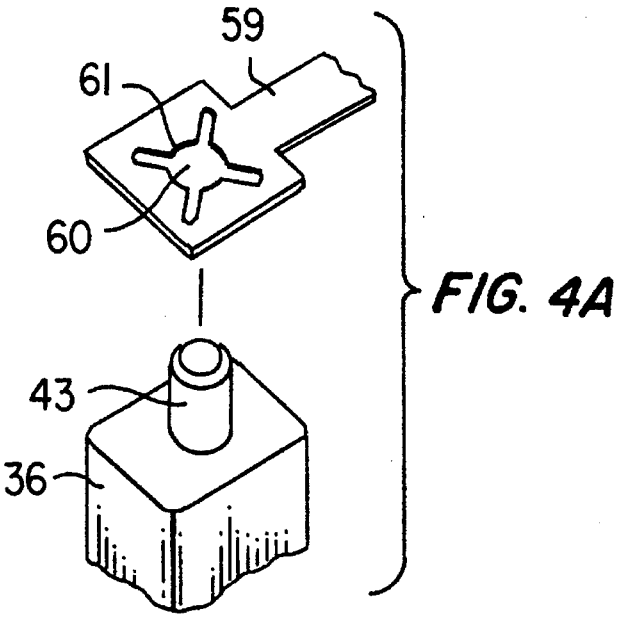
FIG. 4A is a fragmentary perspective view of a bobbin post and a modified pivot arm before fastening.
Figure 4B:
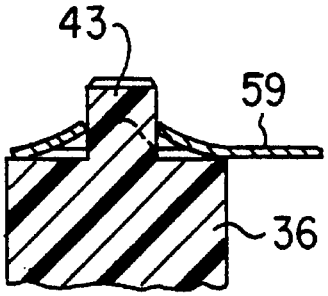
FIG. 4B is a fragmentary cross section of the bobbin post and pivot arm as in FIG. 3A, after fastening by spring fit.

The movable spring has a pair of torsion pivot arms extending transversely in opposite directions from a central portion thereof and defining a pivot axis for the armature 50. Each of the pivot arms has an eyelet 60 for fastening the movable spring 55 and the armature 50 on the center flange 36 of the bobbin 30. For receiving the pivot arms 59, the bobbin 30 forms a pair of posts 43 extending from the center flange 36 on either side of the armature, and the pivot arms may be fastened by any suitable method. As shown in FIGS. 3A and 3B in greater detail, the eyelet 60 is fitted over the post 43 and fixed by heat staking. Another advantageous method for fastening the pivot arms is shown in FIGS. 4A and 4B. In this case, the eyelet 60 of a pivot arm 59 has a smaller diameter than the post 43 but is surrounded by spring lugs 61. In this case, the pivot arms are retained on the posts 43 by spring fit, as shown in FIG. 4B. Alternatively, the spring fit as shown in FIG. 4B can be fixed additionally by heat staking as shown in FIG. 3B.

When the relay parts are assembled along the broken lines shown in FIG. 1, the central part of the braid 62 is welded to the terminal 15. Further, winding terminals 44, 45 and 46 which are anchored in the bobbin flanges 34, 35 and 36, are connected by welding or any other suitable method to the coil terminals 17, 18 and 19. A plastic cap, not shown, may be put over the assembled relay to form a closed casing together with the base 10.

Figure 11A:
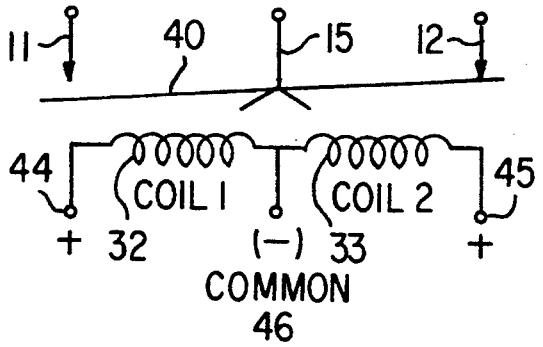
FIG. 11A is a schematic view of a double coil relay energizing circuit in a dual input version.
Figure 11B:
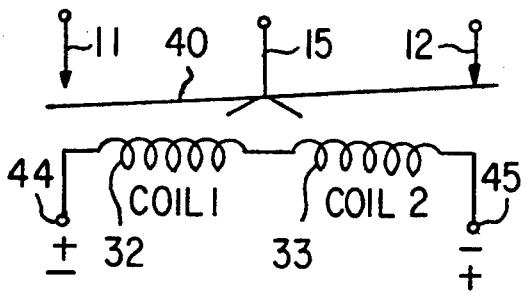
FIG. 11B is schematic view of a double coil relay energizing circuit in a single input version.

In operation, when the coils 32 and 33 are de-energized, the armature 50 is held or kept latched in either of the two stable positions on either one of the pole pieces 38 or 39, respectively. For moving the armature from one position to the other, a voltage pulse is applied across an appropriate coil 32 or 33 in case of a dual input wiring, as is shown in FIG. 11A. In this case, the two coils 32 and 33 are wound in a common direction and have end terminals 44 and 45 as well as a common terminal 46. Armature transfer will occur by applying a voltage pulse across one of the coils 32 or 33. In case of a single input wiring, as is shown in FIG. 11B, the two coils 32 and 33 are connected in series, and the center winding terminal 46 as well as the common coil terminal 19 can be omitted. In this case, armature transfer will occur by toggling the voltage pulse polarity across the two coils 32 and 33 connected in series.

Figure 5:
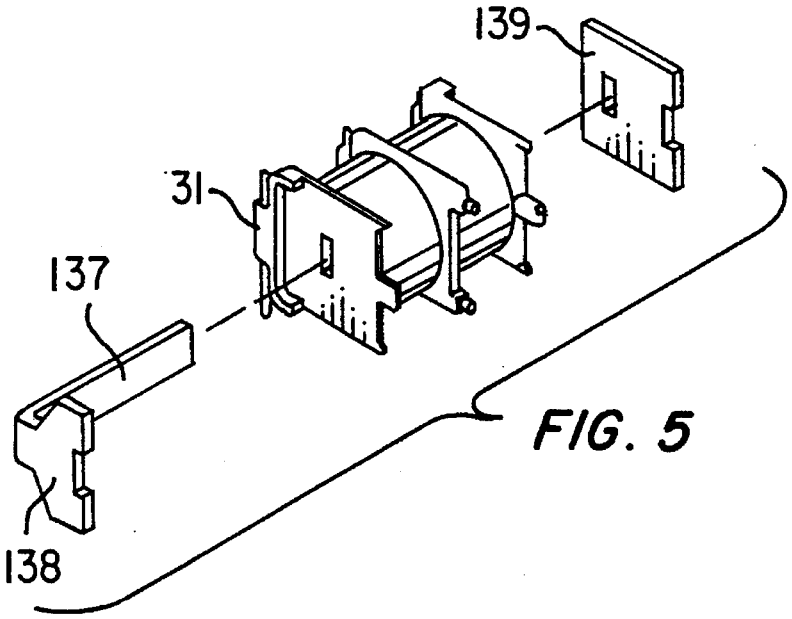
FIG. 5 is an exploded perspective partial view of a coil unit of the relay according to FIG. 1, showing a modified core and pole piece structure.

FIGS. 5 to 9 show different modifications of the system as shown in FIG. 1. Since the system in general is the same or similar to the system of FIG. 1, only those parts will be described now which are different from FIG. 1. In FIG. 5, a modified two piece frame structure is shown. In this case, a core 137 has a rectangular cross section and is bent into an L-shape so as to form integrally a pole piece 138 while the opposite end of the core is connected to a separate pole piece 139.

The embodiments shown in FIGS. 6 to 9 depict a relay having an armature assembly that is balanced on a permanent magnet which is located at the center of an "E-frame" motor structure. In this case, a two-pole permanent magnet is used instead of the three-pole magnet in the system of FIG. 1. The permanent magnet is captured between the two coils and is coupled with one pole (N) to the core, while the other pole (S) faces the center part of the armature.

Figure 6:
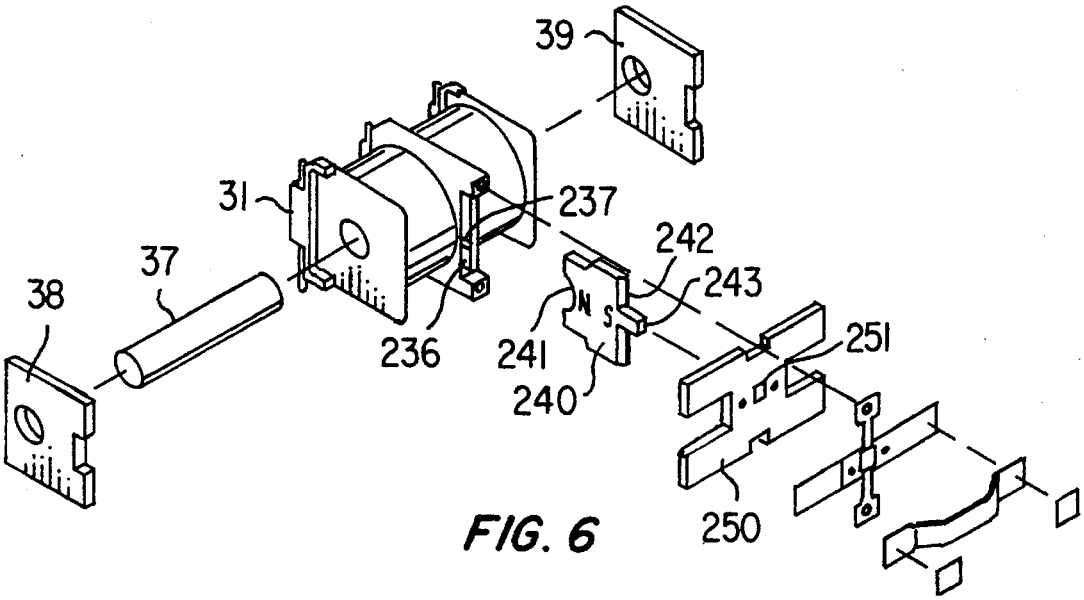
FIG. 6 is an exploded perspective partial view of a coil and armature assembly in a relay according to FIG. 1, showing a modified permanent magnet and armature structure.

In FIG. 6, the bobbin 31 has a center flange 36 with a slot 236 receiving a permanent magnet 240. The magnet 240 has a semicircular recess 241 at its inner end which is designed to rest on the circumference of the cylindrical core 37. Crush ribs 237 are provided within the slot 236 for fixing the magnet 240 in place. The outer end 242 of the magnet forms a bearing edge for an armature 250. Excessive armature motion is restricted in two planes by a tab 243 which is located on the end portion 242 and projects into a center hole 251 of the armature 250.

Figure 7:
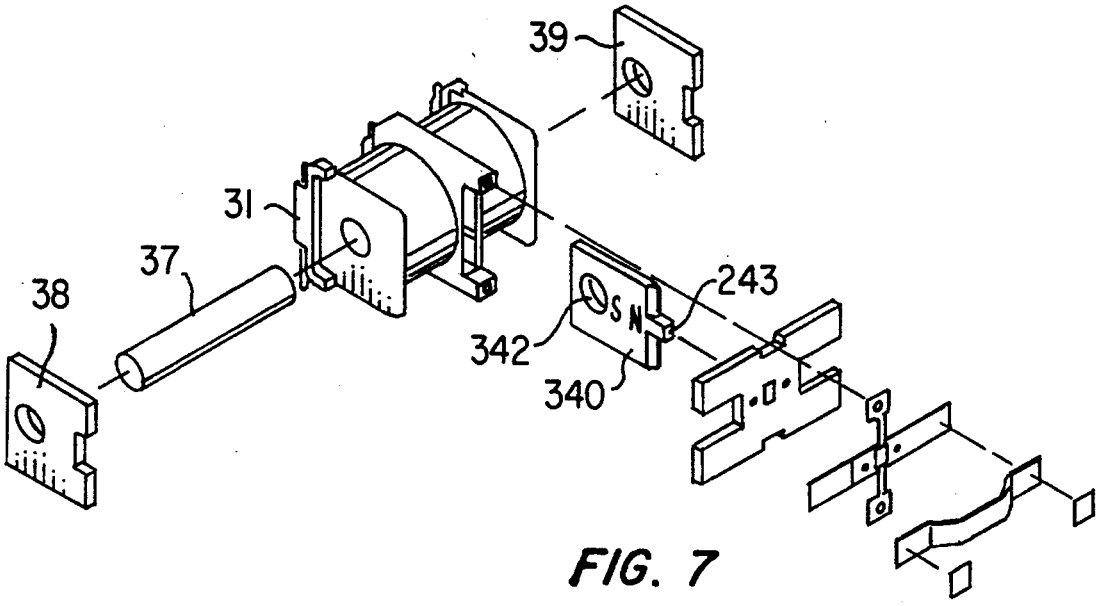
FIG. 7 is an exploded perspective partial view as in FIG. 6, showing another modified magnet structure.

The relay shown in FIG. 7 are similar to that of FIG. 6 with the exception, that a modified permanent magnet 340 has a cylindrical hole 342, where the cylindrical core 37 passes completely through.

Figure 8:
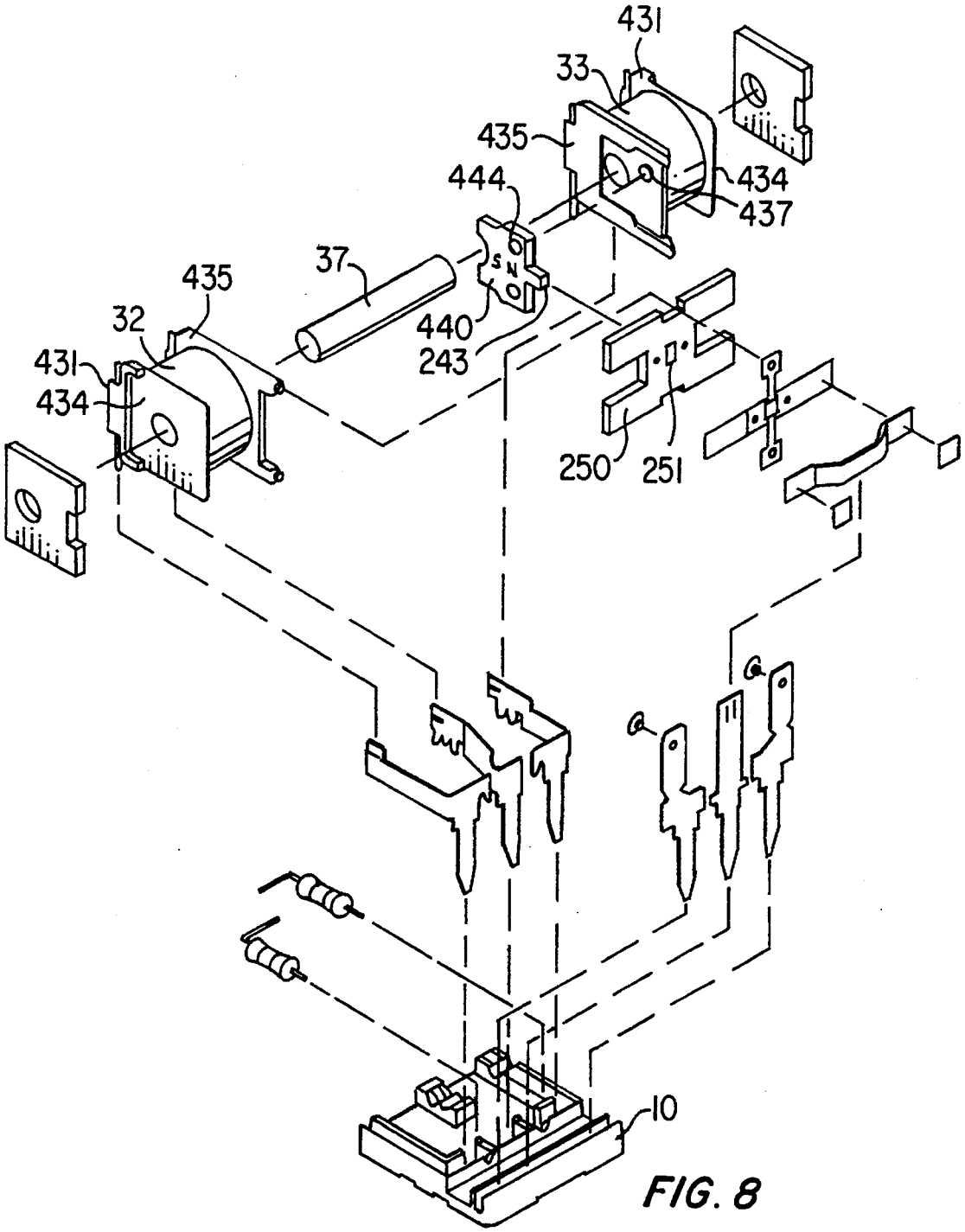
FIG. 8 is an exploded perspective view of a relay as in FIG. 1, showing a further modified bobbin and magnet structure.

FIG. 8 illustrates a modified relay, where a permanent magnet 440 of a similar shape as in FIG. 6 is captured between two identical coil assemblies. Two identical bobbins 431 each having an outer flange 434 and an inner flange 435 are connected at their inner flanges 435 with the permanent magnet 440 captured therebetween. Each of the bobbin flanges 435 is provided with a retention peg 437 mating with a corresponding retention hole 444 provided in the permanent magnet 440. These mating elements 437 and 444 prevent the magnet from backing out. The remaining parts are similar or identical to those of FIG. 6.

Figure 9:
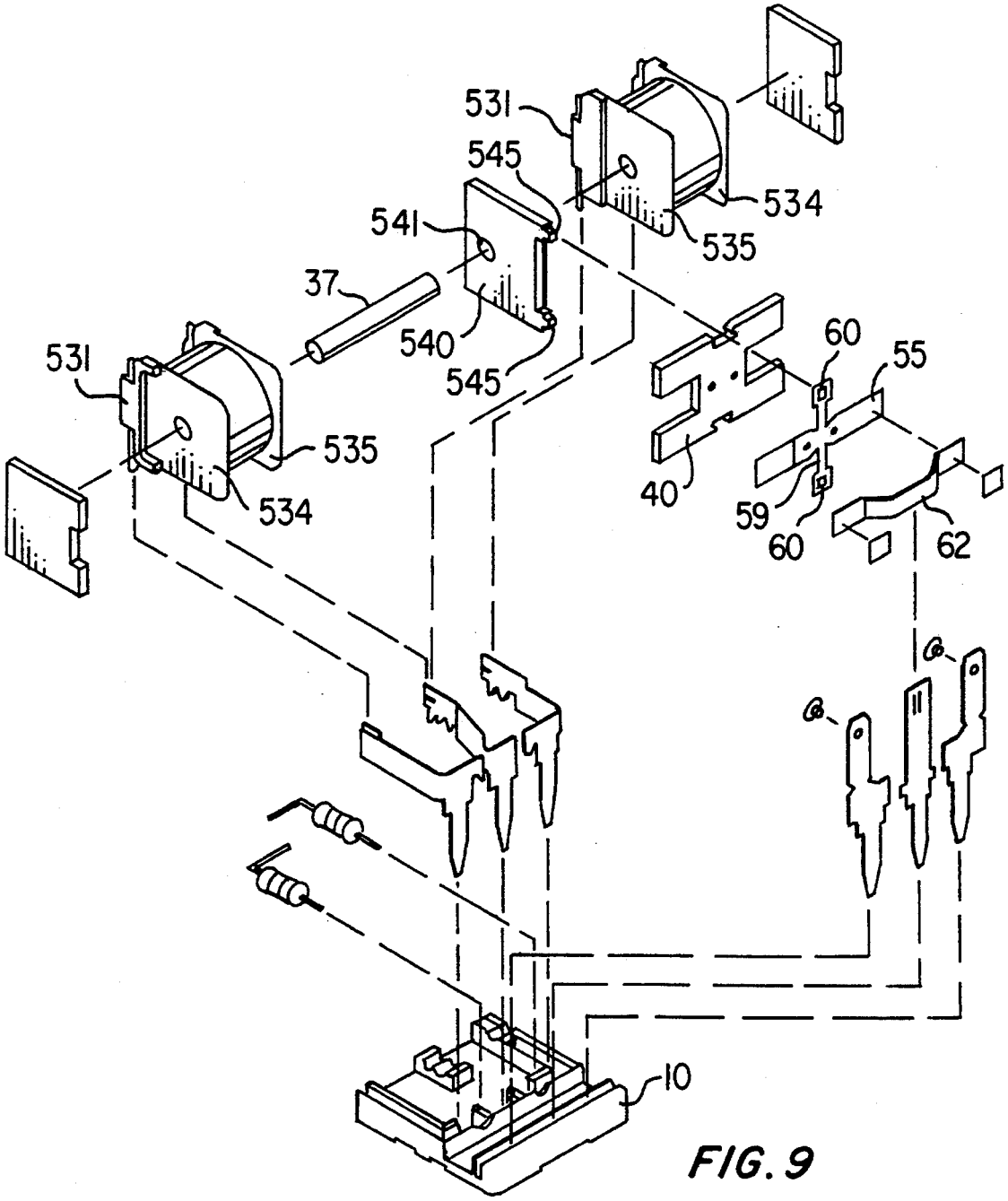
FIG. 9 is an exploded perspective view of a relay as in FIG. 1, showing a still further modified bobbin, magnet and armature structure.

Yet another modification of the system is shown in FIG. 9. Similar to FIG. 8, two identical coil assemblies are used, each having a bobbin 531 with an outer flange 534 and an inner flange 535. A permanent magnet 540 is captured between the inner flanges 535 of the two coil assemblies. In this case, the permanent magnet 540 is prevented from backing out by means of the core 37, which passes completely through a cylindrical hole 541, similar to FIG. 7. Unlike the preceding embodiments, the pivot arms 59 of the movable spring 55 are not fixed to a bobbin part, but rather to posts 545 projecting from the permanent magnet 540 on either side of the armature 40. The eyelets 60 of the pivot arms 59 are fastened to the projecting posts 545 by any suitable metal connecting method, such as welding, soldering or the like.

Figure 10:
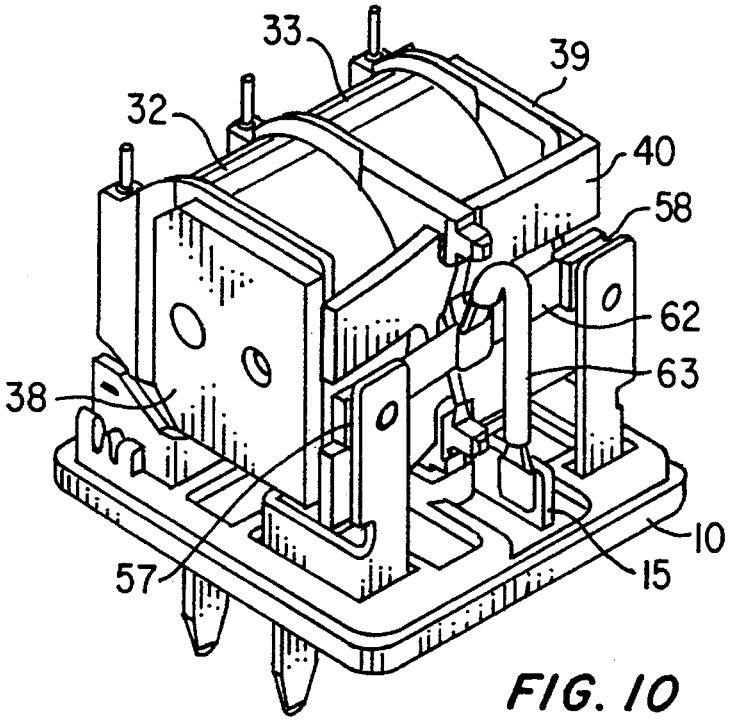
FIG. 10 is a perspective view of a relay as in FIG. 2, showing a modified movable contact terminal connection.

FIG. 10 shows a completely assembled relay similar to FIG. 2, but with minor modifications in the different parts, for example in the shape of the terminals. Compared with FIG. 2, a composite braid is used for connecting the movable contacts to the movable contact terminal 15. In this case, a first flat copper braid 62 spans the length between the two movable contacts 57 and 58. It is fixed in place by being welded between the stainless steel spring 55 and the movable contacts 57 and 58, like the previous embodiments. In order to make the connection to the movable terminal 15, a second braid 63 is welded to the center of the beforementioned flat braid 62, while the opposite free end thereof is welded to the movable terminal 15.

The embodiments described herein are merely illustrative of the principles of the present invention. Various modifications may be made thereto by persons ordinarily skilled in the art, without departing from the scope or spirit of the invention.

For example, it is conceivable also in a structure according to FIG. 1 having a three-pole permanent magnet, to fasten the pivot arms not to a bobbin flange but to metal posts projecting from the magnet.

What is claimed is:

1. A polarized electromagnetic relay, comprising:

an insulating base defining a bottom plane;

an electromagnet block on the base having a core, means for exciting a coil including a bobbin and at least one winding about the core, and a pair of pole pieces extending perpendicularly from the ends of said core;

an elongate armature pivotally supported at its central portion to be movable about a center pivot axis for angular movement between two contact operating positions, either end portion of the armature on either side of the pivot axis defining an air gap with one of said pole pieces;

a permanent magnet coupled magnetically between said core and said armature so as to induce the same magnetic poles in both said pole pieces and to provide an opposite pole in closely adjacent relationship to said central portion of the armature;

at least one movable contact spring fixedly connected to the armature at a portion intermediate the ends thereof and being formed with contact arms in the vicinity of either armature end portion, said contact arms carrying movable contacts to be moved according to the armature movement in and out of contact with corresponding fixed contacts mounted on said base;

a pair of torsion pivot arms extending transversely in opposite directions from said at least one contact spring along the pivot axis of said armature, a distal end of either pivot arm being fixedly connected to a support being part of or fixedly connected to said electromagnet block and extending around either side of the armature; and a conductor connecting said contact arms with a movable contact terminal mounted on said base; wherein said at least one movable contact spring is made from a material having high resilience and said conductor is made of flexible construction from a material having high conductivity.

2. The relay according to claim 1, wherein said bobbin has a pair of end flanges each adjacent to one of said pole pieces and a center flange adjacent the central part of said armature, said center flange providing a pair of posts projecting on either side of the armature and bearing as said supports the distal ends of said pivot arms.

3. The relay according to claim 2, wherein said pivot arms have eyelets formed at their distal ends fitted over said posts and fixed in place by heat staking.

4. The relay according to claim 2, wherein said pivot arms have eyelets formed at their distal ends fitted over said posts and fixed in place by a spring fit.

5. The relay according to claim 1, wherein said conductor comprises a composite braid, consisting of a first braid portion spanning the length between the two movable contacts and a second braid portion connecting the center of said first braid portion with the movable contact terminal.

6. The relay according to claim 1, wherein said pivot arms are fixed to said permanent magnet on either side of the armature.

7. The relay according to claim 1, wherein said core has a cylindrical shape and is connected at its ends with either one of a pair of identical plate-shaped pole pieces.

8. The relay according to claim 1, wherein said core is bent at one end into an L-shape to form integrally one of said pole pieces and is connected at its other end to a plate-shaped pole piece.

9. The relay according to claim 1, wherein said armature is H-shaped, each of its end portions defining a pair of legs with a central recess therebetween, and wherein a single contact spring is fixed on the armature so as to have a pair of contact arms each of which is arranged above either one of said recesses, each of said recesses being greater in width than the corresponding contact arm and allowing said contact arm to immerse between the armature legs when butting against a corresponding fixed contact.

10. A polarized electromagnetic relay, comprising:

an insulating base defining a base plane;

a bobbin with a pair of coils wound thereon, said bobbin having a pair of end flanges and a center flange separating said pair of coils, a core extending axially in said bobbin and parallel to the base plane and a pair of pole pieces extending perpendicularly from either end of said core;

an elongate armature pivotally supported at its central portion to be movable about a center pivot axis for angular movement between two contact operating positions, either end portion of the armature on either side of the pivot axis defining an air gap with one of said pole pieces;

an elongate three-pole magnetized permanent magnet disposed between the free ends of the pole pieces in closely adjacent relationship to the armature, said permanent magnet being magnetized to have the same poles at its lengthwise ends and the opposite pole intermediate its ends;

a movable contact spring fixedly connected to the armature at a portion intermediate the ends thereof and being formed with a pair of contact arms in the vicinity of either armature end portion, each of said contact arms carrying a movable contact to be moved according to the armature movement in and out of contact with corresponding fixed contacts on fixed contact terminals mounted on said base;

a pair of torsion pivot arms extending transversely in opposite directions from said contact spring along the pivot axis of said armature, a distal end of either pivot arm being fixedly connected to a post extending from said center flange of said bobbin; and a conductor connecting said movable contact with a movable contact terminal mounted on said base; wherein said movable contact spring is made from a material having high resilience and said conductor is made of flexible construction from a material having high conductivity.

11. The relay according to claim 10, wherein said permanent magnet and said armature are arranged along a lateral side of said bobbin, said pivot axis as well as said fixed and movable contact terminals extending essentially perpendicular to said base plane.

12. A polarized electromagnetic relay, comprising:

an insulating base defining a base plane;

a bobbin with a pair of coils wound thereon, said bobbin having a pair of end flanges and a center flange separating said pair of coils, a core extending axially in said bobbin and parallel to the base plane a pair of pole pieces extending perpendicularly from either end of said core;

an elongate armature pivotally supported at its central portion to be movable about a center pivot axis for angular movement between two contact operating positions, either end portion of the armature on either side of the pivot axis defining an air gap with one of said pole pieces and said pivot axis of said armature extending perpendicularly to said base plane;

an elongate two-pole permanent magnet arranged in said center flange perpendicularly to the axis of said core and coils, said magnet being coupled with one pole to said core and presenting the opposite pole to the armature which is balanced thereon;

a movable contact spring fixedly connected to the armature at a portion intermediate the ends thereof and being formed with a pair of contact arms in the vicinity of either armature end portion, each of said contact arms carrying a movable contact to be moved according to the armature movement in and out of contact with corresponding fixed contacts on fixed contact terminals mounted on said base;

a pair of torsion pivot arms extending transversely in opposite directions from said contact spring along the pivot axis of said armature, a distal end of either pivot arm being fixedly connected to a post extending from said center flange of said bobbin; and a conductor connecting said movable contact with a movable contact terminal mounted on said base; wherein said at least one movable contact spring is made from a material having high resilience and said conductor is made of flexible construction from a material having high conductivity.

13. The relay according to claim 12, wherein said permanent magnet and said armature are arranged along a lateral side of said bobbin, said pivot axis as well as said fixed and movable contact terminals extending essentially perpendicular to said base plane.

14. The relay according to claim 12, wherein said bobbin has a single piece structure and said permanent magnet is dropped in a slot of said center flange.

15. The relay according to claim 12, wherein said bobbin has a two-piece structure with two identical coil units being fixed together and the permanent magnet being captured therebetween.

16. The relay according to claim 12, wherein said permanent magnet has a cylindrical hole where the core passes through.

17. The relay according to claim 12, wherein the permanent magnet is designed at one end to rest on the circumference of the cylindrical core.

18. The relay according to claim 12, wherein said permanent magnet has a tab projecting from the end balancing the armature, said tab projecting into a recess in the armature and restricting excess armature stroke in two planes.

19. The relay according to claim 12, said posts are formed integrally on said center flange projecting on either side of the armature and bearing said pivot arms.

20. The relay according to claim 12, wherein said permanent magnet has a pair of posts projecting from the end balancing the armature on either side of the armature and forming a support for the pivot arms.

* * * * *

UNITED STATES PATENT AND TRADEMARK OFFICE

CERTIFICATE OF CORRECTION

PATENT NO. : 5,587,693

DATED : Dec. 24, 1996

INVENTOR(S) : Fear

It is certified that error appears in the above-indentified patent and that said Letters Patent is hereby corrected as shown below:

Column 10

Line 11, delete: "12" and insert in its place --11--

Signed and Sealed this

Fifteenth Day of July, 1997

Bruce Lehman

*Attest:*

BRUCE LEHMAN

*Attesting Officer*

*Commissioner of Patents and Trademarks*